US006659174B2

(12) United States Patent
Hogan

(10) Patent No.: US 6,659,174 B2
(45) Date of Patent: Dec. 9, 2003

(54) SYSTEM AND METHOD OF TRACKING USE TIME FOR ELECTRIC MOTORS AND OTHER COMPONENTS USED IN A SUBTERRANEAN ENVIRONMENT

(75) Inventor: James R. Hogan, Bartlesville, OK (US)

(73) Assignee: Schlumberger Technology Corp., Sugar Land, TX (US)

( * ) Notice: Subject to any disclaimer, the term of this patent is extended or adjusted under 35 U.S.C. 154(b) by 52 days.

(21) Appl. No.: 10/068,688

(22) Filed: Feb. 6, 2002

(65) Prior Publication Data

US 2002/0130783 A1 Sep. 19, 2002

Related U.S. Application Data

(60) Provisional application No. 60/275,771, filed on Mar. 14, 2001.

(51) Int. Cl.[7] ..... E21B 43/00; E21B 47/00; E21B 47/12

(52) U.S. Cl. ..... 166/250.01; 166/66; 166/66.4; 340/679; 340/854.5; 417/63

(58) Field of Search ..... 340/635, 679, 340/540, 853.1, 680, 854.4, 854.5; 166/66, 250.01, 105, 66.4; 417/63

(56) References Cited

U.S. PATENT DOCUMENTS

| | | | | | |
|---|---|---|---|---|---|
| 4,259,603 | A | * | 3/1981 | Uchiyama et al. | 310/68 B |
| 4,413,676 | A | * | 11/1983 | Kervin | 166/53 |
| 4,666,375 | A | * | 5/1987 | Kime | 417/46 |
| 5,293,937 | A | * | 3/1994 | Schultz et al. | 166/250.01 |
| 5,670,931 | A | * | 9/1997 | Besser et al. | 340/310.01 |
| 5,868,201 | A | * | 2/1999 | Bussear et al. | 166/53 |
| 5,894,273 | A | * | 4/1999 | Meador et al. | 340/606 |
| 6,167,965 | B1 | * | 1/2001 | Bearden et al. | 166/250.15 |
| 6,487,903 | B2 | * | 12/2002 | Sabini et al. | 73/168 |

* cited by examiner

*Primary Examiner*—David Bagnell
*Assistant Examiner*—Thomas S. Bomar
(74) *Attorney, Agent, or Firm*—Robert Van Someren; Jeffrey E. Griffin; Brigitte Jeffery Echols

(57) ABSTRACT

A component, such as an electric motor, for use in a subterranean environment. The component comprises an attached recording system to record the cumulative use time of the component. The recording system typically includes a timing circuit or other circuit to output data related to use of the component. This data is recorded by a recording device to maintain a cumulative total.

15 Claims, 3 Drawing Sheets

SYSTEM AND METHOD OF TRACKING USE TIME FOR ELECTRIC MOTORS AND OTHER COMPONENTS USED IN A SUBTERRANEAN ENVIRONMENT

CROSS-REFERENCE TO RELATED APPLICATIONS

The following is based on and claims the priority of provisional application No. 60/275,771 filed Mar. 14, 2001.

FIELD OF THE INVENTION

The present invention relates generally to components used in subterranean environments, and by way of example to submersible electric motors that are reused and/or serviced based at least on length of service.

BACKGROUND OF THE INVENTION

This section is believed to be helpful in providing the reader with background information to facilitate a better understanding of the various aspects of the present invention. Accordingly, it should be understood that these statements are to be read in this light, and not as admissions of prior art.

Electric motors and other components are used in a variety of subterranean applications, such as electric submersible pumping systems. In one example, the submersible motor, along with the rest of the submersible pumping system, may be inserted into a wellbore and lowered until submerged in the desired oil and/or other fluids. The desired fluids collect in the wellbore, and are raised to a point above the earth's surface via the submersible pumping system powered by the submersible motor.

A typical submersible motor, used to pump production fluids from beneath the earth's surface, has an outer housing substantially sealed from the production fluid environment and sized to fit within standard wellbore casings. An exemplary submersible motor is a three-phase induction-type motor, having a shaft rotatably mounted within the housing such that it is in general alignment with the axis of the wellbore when residing in the wellbore.

Power may be supplied to the submersible electric motor via a power cable that runs along the deployment system. Typically, the power cable is banded or supported along either the outside or the inside of the deployment system. Generally, the power cable is routed to the electric motor to supply electric power thereto, and the submersible pump is powered by the motor by way of an appropriate drive shaft.

Periodically, the submersible motor, along with the rest of the submersible pumping system, must be removed from the well for movement to another well, for servicing, for replacement, etc. When servicing is required, the submersible motor is disconnected from the remainder of the submersible pumping system and shipped back to the factory or a servicing location. Disassembly of conventional motors sometimes requires the breaking or removal of weldments, making servicing difficult in a field environment. Of course, the cost and delay associated with shipping motors to a servicing center are undesirable. Servicing also can lead to downtime at the well which interrupts production of the petroleum or other wellbore fluid.

Attempts have been made to reduce downtime by providing accurate data regarding the service time of the motor. Such data can be useful in estimating remaining life of the motor, need for servicing, the parts that may be required for servicing, etc.

In some applications, external recording devices monitor the length of time a given system, e.g. a submersible pumping system, has been in service. However, the data does not apply to individual components, such as motors, once those components have been separated from the system or combined with another system. Additionally, external recording devices cannot capture previous component use. The external recording device only tracks time of use for the overall system once assembled.

SUMMARY OF THE INVENTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

The present invention provides an innovative approach to evaluating and servicing subterranean systems and components, such as electric motors. While the approach may be utilized in a variety of different fields and with different components and systems, an exemplary use is with electric motors used in, for example, submersible pumping systems. The technique incorporates a cyclic event monitor and recorder within the circuitry of a device, such as an electric motor.

The addition of a recording device within an electric motor limits service-reporting errors and decreases down time of the motor. Therefore, with an internal cyclic event monitor and recorder, the time to failure estimates and quality considerations stay within the confines of the product.

BRIEF DESCRIPTION OF THE DRAWINGS

The foregoing and other advantages and features of the invention will become apparent upon reading the following detailed description and upon reference to the drawings in which.

DETAILED DESCRIPTION OF EXEMPLARY EMBODIMENTS

One or more embodiments of the present invention are described below. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. The descriptions following are by way of example only illustrating embodiments of the present invention. The method and apparatus of the present invention may be applied in a similar manner in other embodiments, without departing from the spirit of the invention.

Figure 1:
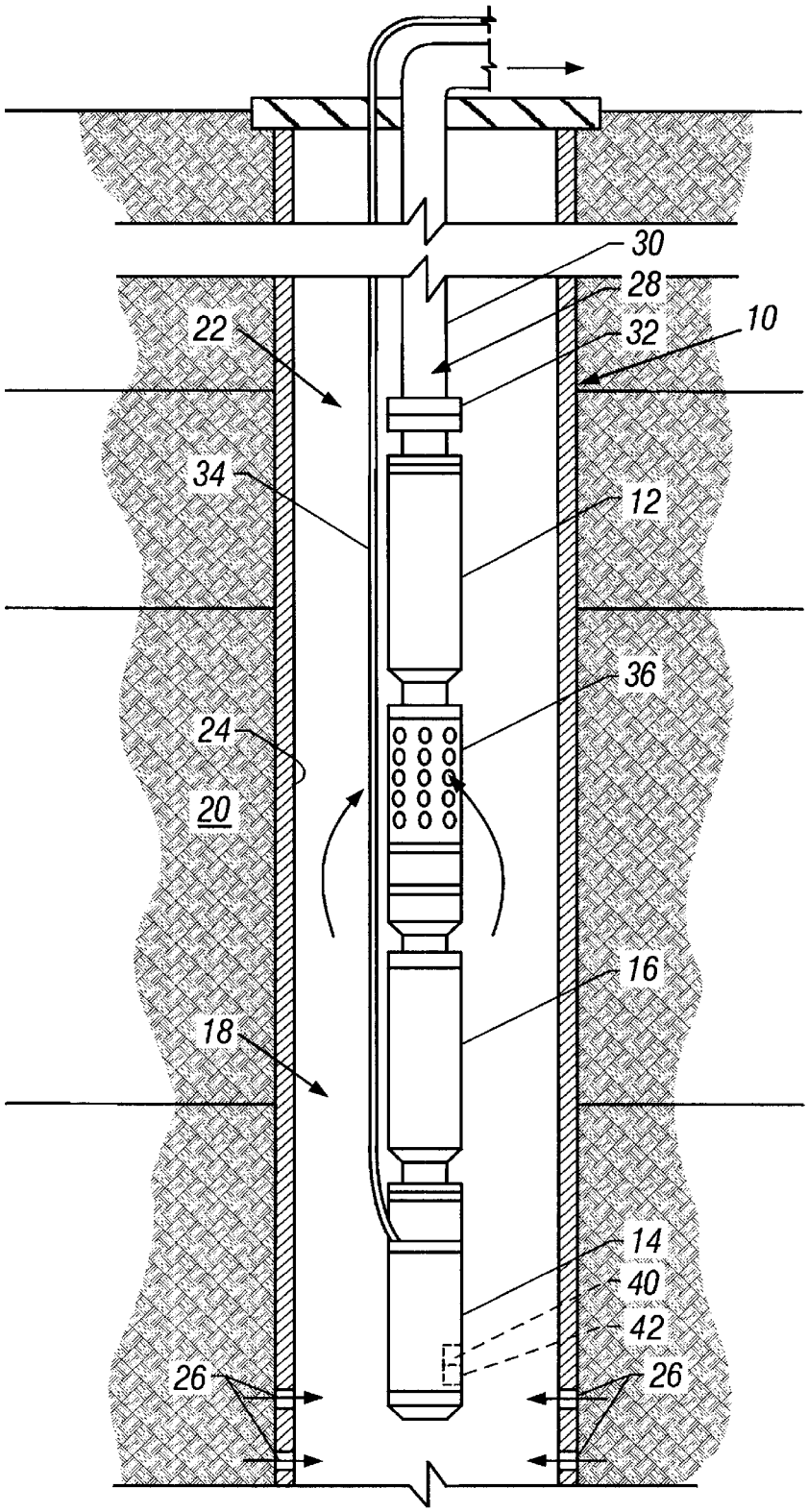
FIG. 1 is a front, elevational view of a submersible pumping system, according to an exemplary embodiment of the present invention.

Referring generally to FIG. 1, an exemplary pumping system 10, such as an electric submersible pumping system, is illustrated. Pumping system 10 may comprise a variety of components depending on the particular application or environment in which it is used. Typically, system 10 includes at least a pump 12, such as a centrifugal pump, a motor 14 and a motor protector 16.

In the illustrated example, pumping system 10 is designed for deployment in a well 18 within a geological formation 20 containing desirable production fluids, such as petroleum. In an exemplary application, a wellbore 22 is drilled into geological formation 20 and lined with a wellbore casing 24. Wellbore casing 24 may include a plurality of openings 26 through which production fluids may flow into wellbore 22.

Pumping system 10 is deployed in wellbore 22 by a deployment system 28 that may have a variety of forms and configurations. For example, deployment system 28 may comprise tubing 30 connected to pump 12 by an appropriate connector 32. Power is provided to submergible motor 14 via a power cable 34. Motor 14, in turn, powers centrifugal pump 12 which draws production fluid in through a pump intake 36 and pumps the production fluid to the surface or other location via tubing 30.

It should be noted that the illustrated submersible pumping system is merely an exemplary embodiment. Other components can be added to this system, and other deployment systems may be implemented. Additionally, a variety of motors 14 can be used to power to downhole pumping system or other type of downhole system. In any of these configurations, it may be desirable to track the uselife of a component, such as motor 14.

Components of submersible pumping system 10 are particularly well suited for a data recording system 40 utilizing a cyclic event monitor 42. It will be appreciated by those skilled in the art that the unique features of a system component, e.g. motor 14, in combination with recorder 40 and cyclic event monitor 42 may be adapted for use in any system for tracking the uselife of the component. Tracking of uselife can be beneficial for a variety of components, but it is particularly amendable for tracking uselife of submersible motors.

Figure 2:
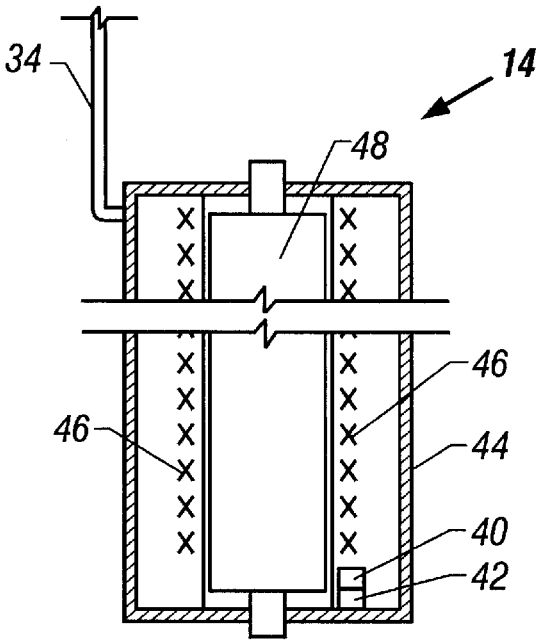
FIG. 2 is a schematic view of an electric submersible motor, according to an exemplary embodiment of the present invention.

As illustrated in FIG. 2, an exemplary submersible motor 14 is the 562 series motor manufactured under the tradename REDA for Schlumberger Corporation. The 562 series motor is a three-phase, induction-type motor, but the present invention can be adapted to a variety of submersible motors of various sizes, diameters, and designs. FIG. 2 generally illustrates a submersible electric motor 14 having an external housing 44 through which power cable 34 extends. The electric motor 14 generally comprises a stator 46, a rotor 48, and recording device 40.

Recording device 40 may have a variety of forms, but typically is coupled to cyclic event monitor 42 which, in one embodiment, comprises a timing circuit. The cyclic event monitor 42 tracks the uselife of electric motor 14 regardless of whether motor 14 is combined into a different system and/or application. The recording device 40 may comprise, for example, a memory chip to store data from cyclic event monitor 42. The cyclic event monitor 42 may have a variety of forms, as would be recognized by one of ordinary skill in the art. For example, cyclic event monitor 42 may comprise a chip having a timing circuit activated upon activation of motor 14 to provide an output to recording device 40 which records the actual time of use of motor 14.

Alternatively, the timing circuit/cyclic event monitor 42 can be designed to count the revolutions of the rotor 48 by sensing, for example, a magnet affixed to rotor 48. The cyclic event monitor can take the form of a chip, a hardwired circuit, a mechanical counter or a variety of other forms depending on the specific design of electric motor 14. Additionally, cyclic event monitor 42 can be mounted in other types of components, e.g. pumps, motor protectors, etc., to track the total time of use of the individual component.

In one embodiment, recording device 40 and cyclic event monitor 42 comprise a mechanical counter and recorder able to count and record, for example, the shaft revolutions of the component. The mechanical counter can be designed similar to an odometer that is mechanically or otherwise connected to the rotatable portion of the component. Such mechanical counters and recorders are amenable to use with components that do not receive electrical power, e.g. pumps, motor protectors, etc.

Figure 3:
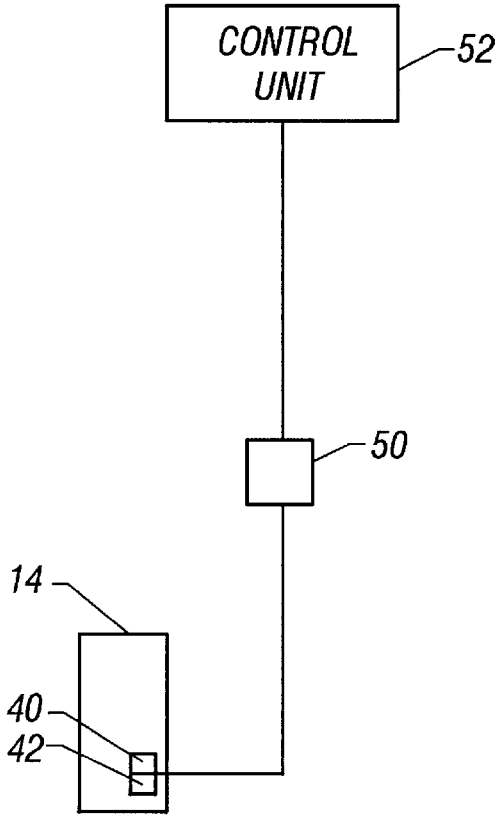
FIG. 3 is a block diagram representing an electric submersible motor illustrated in FIG. 2.

As illustrated in the block diagram of FIG. 3, recording device 40 may be designed to transmit data via a transmitter 50 to a control unit 52. The control unit 52 may be any type of system whereby data can be stored and analyzed. The control unit 52 may be coupled to the transmitter 50 through a conduit or it can be wireless. In this embodiment, a recording device 40 is shown internal to the electric motor. In another embodiment the recording device 40 may be coupled to the electric motor 12 through a wireless system.

Figure 4:
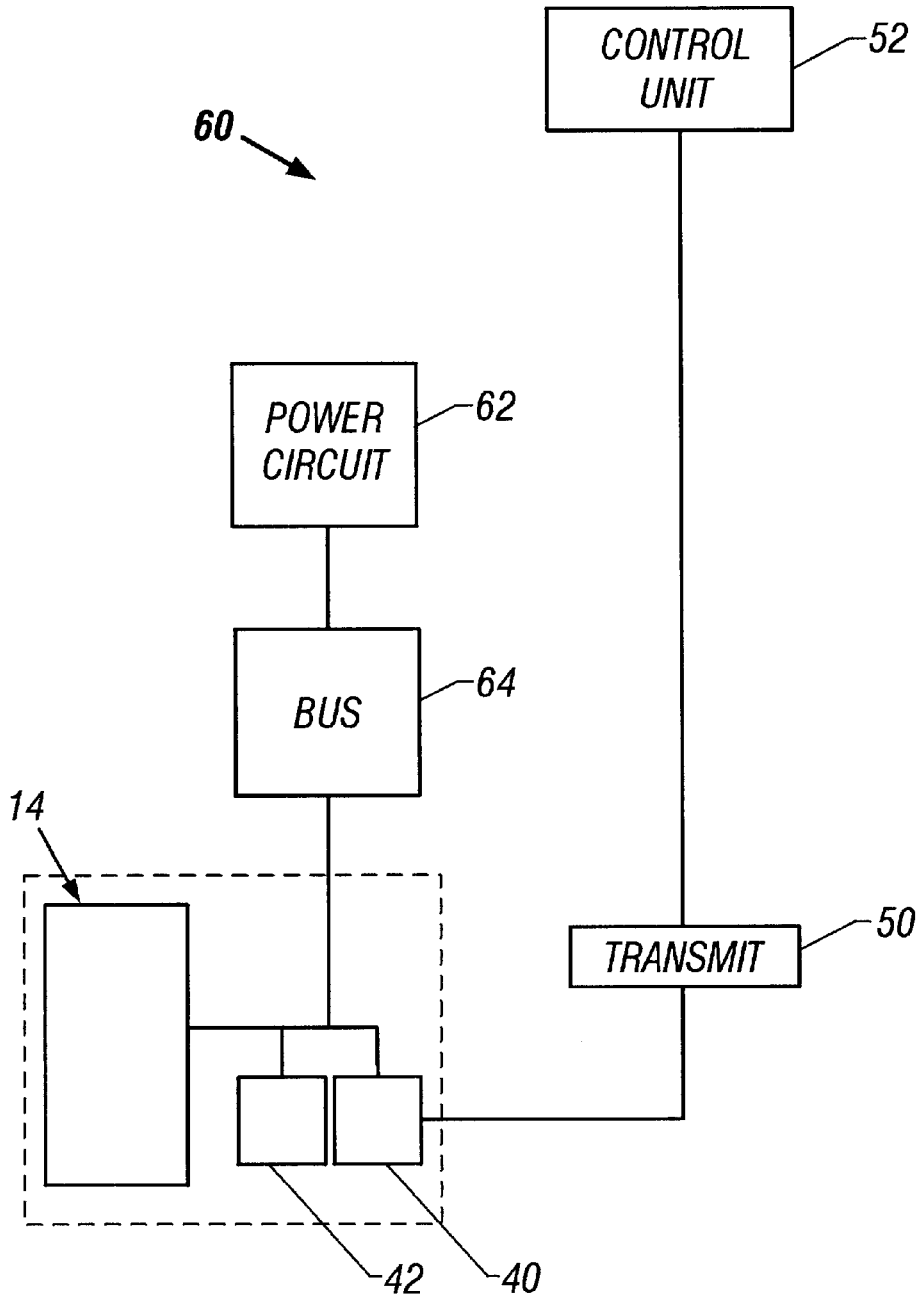
FIG. 4 is a block diagram illustrating the coupling of a power supply to the recording device, according to an exemplary embodiment of the present invention.

Referring generally to FIG. 4, a block diagram of a power system 60 of an exemplary of a submersible pumping system 10 is illustrated. A power circuit 62 external of the submersible motor 14 is couplable to a direct current bus 64. The direct current bus 64 allows the power circuit 62 to provide power to the electric motor 14 and the recording device 40. Recording device 40, in turn, is coupled to transmitter 50, which transmits data to control unit 52.

The cyclic event monitor 42 also may be disposed within the recording device 40 or separate from recording device 40. In this embodiment, power is supplied through the power cable 34 to submersible motor 14 and serves to activate recording device 40 and cyclic event monitor 42. Current passes through the circuitry of the electric motor 14 activating device 40 and cyclic event monitor 42. When the monitor 42 is activated, recording device 40 maintains total time of use data concerning the use of the electric motor 14. As described above, this data is sent through transmitter 50 to control unit 52, where the data may be stored and analyzed.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method for tracking service time of an electric motor utilized in a subterranean environment, comprising:

measuring the time of use of a motor via a recording device located proximate an electric motor disposed in a subterranean environment;

collecting data from the recording device;

transmitting data accumulated by the recording device; and servicing the motor based on data recorded by the recording device.

2. The method as recited in claim 1, further comprising configuring the recording device with a timing circuit.

3. A method for reporting, evaluating and servicing an electric motor in a submersible pumping system, comprising:

measuring the service life for an electric motor disposed in a submersible pumping system via a recording device located within the electric motor;

transmitting data collected by the recording device through a transmitter to a control unit located in a position different from the electric motor;

evaluating data transmitted to the control unit; and determining a service time for the electric motor based on data transmitted to the control unit.

4. The method as recited in claim 3, further comprising connecting the recording device to an electric circuitry of the electric motor.

5. The method as recited in claim 3, further comprising activating the recording device when current is passed through the electric motor.

6. The method as recited in claim 3, further comprising providing the recording device with a timing circuit.

7. An electric motor system for use in a subterranean environment, comprising:

a housing;

a stator disposed within the housing, the stator having a center opening;

a rotor disposed within the opening; and a recording device coupled to a cyclic event monitor, the recording device and the cyclic event monitor being disposed within the housing, wherein the recording device maintains a log of cumulative service time.

8. The electric motor system as recited in claim 7, wherein the recording device is activated by the flow of current passing through the electric motor during operation.

9. The electric motor system as recited in claim 7, further comprising a data transmitter coupled to the recording device.

10. The electric motor system as recited in claim 9, further comprising a control unit configured to receive data transmitted by the data transmitter.

11. A control system for usage in determining service life of an electric submersible pumping system component, comprising:

an electric submersible pumping system component having an external housing; and a recording system disposed within the external housing to track and record total time of use, wherein the recording device comprises a mechanical counter.

12. The control system as recited in claim 11, wherein the recording system is coupled to the electric submersible pumping system component circuitry.

13. The control system as recited in claim 11, wherein the recording system is activated when current is passed through the electric submersible pumping system component.

14. The control system as recited in claim 11, further comprising a transmitter to transmit data collected by the recording system.

15. The control system as recited in claim 14, further comprising a control unit programmed to receive data from the transmitter.

* * * * *